US009982319B2

(12) United States Patent
Kurz et al.

(10) Patent No.: US 9,982,319 B2
(45) Date of Patent: May 29, 2018

(54) METHOD FOR PRESS-HARDENING STEEL

(71) Applicant: voestalpine Stahl GmbH, Linz (AT)

(72) Inventors: Thomas Kurz, Linz (AT); Andreas Pichler, Vöcklabruck (AT)

(73) Assignee: voestalpine Stahl GmbH, Linz (AT)

( * ) Notice: Subject to any disclaimer, the term of this patent is extended or adjusted under 35 U.S.C. 154(b) by 717 days.

(21) Appl. No.: 14/408,712

(22) PCT Filed: Jun. 25, 2013

(86) PCT No.: PCT/EP2013/063282
§ 371 (c)(1),
(2) Date: Dec. 17, 2014

(87) PCT Pub. No.: WO2014/001336
PCT Pub. Date: Jan. 3, 2014

(65) Prior Publication Data

US 2015/0152517 A1 Jun. 4, 2015

(30) Foreign Application Priority Data

Jun. 26, 2012 (DE) ..... 10 2012 105 580

(51) Int. Cl.
*C21D 11/00* (2006.01)
*C21D 1/18* (2006.01)
(Continued)

(52) U.S. Cl.
CPC ..... *C21D 11/005* (2013.01); *C21D 1/18* (2013.01); *C21D 1/673* (2013.01); *C21D 6/004* (2013.01); *C21D 6/005* (2013.01); *C21D 6/008* (2013.01); *C21D 8/005* (2013.01); *C21D 11/00* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/50* (2013.01); *C22C 38/54* (2013.01);
(Continued)

(58) Field of Classification Search
CPC ..... C21D 7/00; C21D 11/00; C21D 1/18
USPC ..... 148/506
See application file for complete search history.

(56) References Cited

U.S. PATENT DOCUMENTS

2012/0273092 A1 11/2012 Ratte

FOREIGN PATENT DOCUMENTS

DE 102009030489 A1 12/2010

OTHER PUBLICATIONS

Golm, Mathematical Characters, p. 49, Oct. 24, 2012.
(Continued)

*Primary Examiner* — Jie Yang

(57) ABSTRACT

A method for press-hardening steel in which a steel sheet composed of a hardenable steel alloy can either be preformed in a cold state, then transferred to a tool that has the contour of the preformed component and in it, after a preceding heating step that produces a complete austenitization, is cooled in this tool at a speed greater than the critical hardening speed so that a quench hardening of the preformed component is achieved, or a sheet blank composed of a steel with a composition that permits a press hardening is heated to a temperature above the austenitization temperature and is then hot-formed and at the same time, cooled at a speed that is greater than the critical hardening speed so that hardening is produced; and the hardening is produced in that the austenitic structure is converted into an essentially martensitic structure, possibly with a residual quantity of austenite.

3 Claims, 2 Drawing Sheets

(51) Int. Cl.

| | |
|---|---|
| ***C21D 1/673*** | (2006.01) |
| ***C21D 6/00*** | (2006.01) |
| ***C21D 8/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.
CPC ..... *C22C 38/58* (2013.01); *C21D 2211/008* (2013.01)

(56) References Cited

OTHER PUBLICATIONS

Neugebauer et al., "Influence of the Alloying Elements on Phase Transitions of High Strength Steels," Advanced Materials Research, Trans Tech Publications Ltd., Switzerland, vol. 337, pp. 358-362, Oct. 28, 2011.

Sikora et al., "Tailored Tempering: Customized Material Properties for Hot-Stamped Parts," ThyssenKrupp Techforum [online] Nr. 1, pp. 10-15, Jan. 1, 2012 URL:https://www.thyssenkrupp.com/documents/Publikationen/Techforum/techforum_1_12_en.pdf.

"Underlying Metallurgy. Transformation Diagrams (CCT & TTT)," University of Liverpool, Jul. 25, 2000 URL:http://www.matter.org.uk/steelmatter/metallurgy/7_1_2.html.

| Variant | C | Si | Mn | Al | Cr | Ni | Mo | V | Nb | Ti | B | PHM | PHK |
|---|---|---|---|---|---|---|---|---|---|---|---|---|---|
| | [%] | [%] | [%] | [%] | [%] | [%] | [%] | [%] | [%] | [%] | [%] | [K/s] | [K/s] |
| A | 0.239 | 0.21 | 1.17 | 0.13 | 0.25 | 0.01 | 0.00 | 0.002 | 0.000 | 0.002 | 0.0029 | 20 | 23.1 |
| B | 0.223 | 0.19 | 2.35 | 0.05 | 0.26 | 0.01 | 0.00 | 0.003 | 0.001 | 0.022 | 0.0022 | 5 | 8.4 |
| C | 0.164 | 0.78 | 2.15 | 0.01 | 0.02 | 0.01 | 0.07 | 0.002 | 0.002 | 0.001 | 0.0003 | 80 | 76.8 |
| D | 0.172 | 0.78 | 2.36 | 0.01 | 0.02 | 0.01 | 0.08 | 0.002 | 0.002 | 0.001 | 0.0002 | 80 | 64.6 |
| E | 0.173 | 0.79 | 2.29 | 0.01 | 0.31 | 0.01 | 0.00 | 0.002 | 0.002 | 0.001 | 0.0002 | 50 | 76.5 |
| F | 0.177 | 0.79 | 2.29 | 0.02 | 0.31 | 0.01 | 0.00 | 0.002 | 0.025 | 0.001 | 0.0001 | 80 | 66.7 |
| G | 0.174 | 0.79 | 2.31 | 0.02 | 0.31 | 0.01 | 0.00 | 0.002 | 0.089 | 0.001 | 0.0002 | 80 | 51.3 |
| H | 0.174 | 0.79 | 2.49 | 0.02 | 0.02 | 0.01 | 0.00 | 0.002 | 0.002 | 0.001 | 0.0001 | 90 | 91.4 |
| I | 0.174 | 1.00 | 2.48 | 0.02 | 0.02 | 0.01 | 0.00 | 0.002 | 0.002 | 0.001 | 0.0002 | 100 | 76.0 |
| J | 0.242 | 0.23 | 1.19 | 0.27 | 0.25 | 0.01 | 0.00 | 0.002 | 0.000 | 0.003 | 0.0029 | 20 | 20.7 |
| K | 0.244 | 0.23 | 1.18 | 0.41 | 0.25 | 0.01 | 0.00 | 0.002 | 0.001 | 0.003 | 0.0030 | 20 | 19.9 |
| L | 0.238 | 0.24 | 1.18 | 0.37 | 0.25 | 0.01 | 0.00 | 0.002 | 0.017 | 0.004 | 0.0029 | 20 | 18.5 |
| M | 0.259 | 0.18 | 1.95 | 0.03 | 0.26 | 0.01 | 0.19 | 0.003 | 0.041 | 0.019 | 0.0026 | 2 | 1.8 |
| N | 0.248 | 0.16 | 1.99 | 0.03 | 0.25 | 0.01 | 0.00 | 0.003 | 0.021 | 0.020 | 0.0024 | 5 | 8.0 |
| O | 0.245 | 0.16 | 2.00 | 0.02 | 0.26 | 0.01 | 0.00 | 0.003 | 0.041 | 0.015 | 0.0022 | 5 | 7.0 |
| P | 0.228 | 0.19 | 1.55 | 0.05 | 0.25 | 0.01 | 0.00 | 0.003 | 0.001 | 0.023 | 0.0028 | 20 | 17.9 |
| Q | 0.226 | 0.19 | 1.93 | 0.05 | 0.25 | 0.01 | 0.00 | 0.003 | 0.001 | 0.023 | 0.0026 | 10 | 12.1 |
| R | 0.153 | 0.22 | 2.04 | 0.05 | 0.24 | 0.02 | 0.00 | 0.003 | 0.001 | 0.032 | 0.0039 | 25 | 29.2 |
| S | 0.220 | 0.20 | 1.22 | 0.04 | 0.21 | 0.01 | 0.00 | 0.004 | 0.001 | 0.028 | 0.0027 | 30 | 32.8 |
| T | 0.210 | 0.22 | 1.28 | 0.11 | 0.28 | 0.02 | 0.00 | 0.000 | 0.024 | 0.002 | 0.0033 | 40 | 22.7 |
| U | 0.220 | 0.20 | 1.19 | 0.19 | 0.25 | 0.02 | 0.00 | 0.012 | 0.021 | 0.003 | 0.0029 | 40 | 23.9 |
| V | 0.084 | 0.21 | 1.98 | 0.05 | 0.35 | 0.02 | 0.01 | 0.002 | 0.001 | 0.036 | 0.0023 | 150 | 94.0 |
| W | 0.062 | 0.20 | 2.00 | 0.05 | 0.36 | 0.02 | 0.01 | 0.002 | 0.001 | 0.033 | 0.0023 | 200 | 169.0 |
| X | 0.248 | 0.19 | 1.94 | 0.04 | 0.25 | 0.01 | 0.19 | 0.002 | 0.019 | 0.001 | 0.0003 | 20 | 34.5 |
| Y | 0.252 | 0.19 | 1.93 | 0.04 | 0.25 | 0.01 | 0.19 | 0.002 | 0.001 | 0.000 | 0.0003 | 20 | 35.9 |
| Z | 0.256 | 0.18 | 1.95 | 0.03 | 0.26 | 0.01 | 0.19 | 0.002 | 0.041 | 0.001 | 0.0003 | 20 | 31.0 |
| AA | 0.220 | 0.19 | 2.00 | 0.01 | 0.26 | 0.02 | 0.00 | 0.000 | 0.041 | 0.001 | 0.0002 | 150 | 95.4 |
| AB | 0.220 | 0.20 | 2.01 | 0.02 | 0.25 | 0.02 | 0.00 | 0.000 | 0.021 | 0.001 | 0.0003 | 120 | 106.5 |
| AC | 0.241 | 0.15 | 1.95 | 0.03 | 0.25 | 0.01 | 0.00 | 0.003 | 0.002 | 0.018 | 0.0024 | 5 | 10.5 |
| AD | 0.214 | 0.19 | 1.16 | 0.05 | 0.25 | 0.01 | 0.00 | 0.003 | 0.001 | 0.024 | 0.0027 | 30 | 37.2 |
| AE | 0.230 | 0.20 | 1.20 | 0.02 | 0.25 | 0.02 | 0.00 | 0.020 | 0.001 | 0.022 | 0.0029 | 40 | 26.3 |
| AF | 0.220 | 0.20 | 1.24 | 0.02 | 0.25 | 0.02 | 0.00 | 0.020 | 0.001 | 0.021 | 0.0016 | 250 | 243.9 |
| AG | 0.240 | 0.21 | 2.05 | 0.02 | 0.26 | 0.02 | 0.00 | 0.020 | 0.001 | 0.001 | 0.0001 | 80 | 98.7 |
| AH | 0.176 | 0.79 | 2.19 | 0.03 | 0.32 | 0.01 | 0.00 | 0.002 | 0.002 | 0.001 | 0.0001 | 80 | 78.5 |
| AI | 0.175 | 0.78 | 2.39 | 0.03 | 0.32 | 0.01 | 0.00 | 0.001 | 0.002 | 0.001 | 0.0001 | 60 | 71.3 |
| AJ | 0.173 | 0.77 | 2.46 | 0.04 | 0.32 | 0.01 | 0.00 | 0.001 | 0.002 | 0.001 | 0.0001 | 50 | 70.1 |
| AK | 0.170 | 0.83 | 2.35 | 0.02 | 0.02 | 0.01 | 0.00 | 0.002 | 0.002 | 0.001 | 0.0003 | 100 | 99.9 |
| AL | 0.173 | 0.80 | 2.34 | 0.02 | 0.20 | 0.01 | 0.00 | 0.002 | 0.002 | 0.001 | 0.0001 | 80 | 82.2 |
| AM | 0.172 | 0.78 | 2.29 | 0.02 | 0.37 | 0.01 | 0.00 | 0.002 | 0.002 | 0.001 | 0.0002 | 60 | 73.3 |
| AN | 0.165 | 0.95 | 2.32 | 0.01 | 0.02 | 0.01 | 0.07 | 0.002 | 0.002 | 0.001 | 0.0003 | 80 | 60.8 |
| AO | 0.173 | 0.78 | 2.29 | 0.02 | 0.31 | 0.01 | 0.00 | 0.002 | 0.045 | 0.001 | 0.0002 | 100 | 63.1 |
| AP | 0.173 | 0.69 | 2.49 | 0.02 | 0.02 | 0.01 | 0.00 | 0.002 | 0.002 | 0.001 | 0.0002 | 80 | 101.6 |
| AQ | 0.174 | 0.89 | 2.48 | 0.02 | 0.02 | 0.01 | 0.00 | 0.002 | 0.002 | 0.001 | 0.0002 | 90 | 83.7 |

Fig. 1

METHOD FOR PRESS-HARDENING STEEL

FIELD OF THE INVENTION

The invention relates to a method for press-hardening steel in which a steel sheet composed of a hardenable steel alloy can either be preformed in a cold state, then transferred to a tool that essentially has the contour of the preformed component and in it, after a preceding heating step that produces a complete austenitization, is cooled in this tool at a speed that is greater than the critical hardening speed so that a quench hardening of the preformed component is achieved or a sheet blank composed of a steel with a composition that permits a press hardening is heated to a temperature above the austenitization temperature and is then hot-formed in a tool and at the same time, cooled at a speed that is greater than the critical hardening speed so that a hardening is produced; and the hardening is produced in that the austenitic structure is converted into an essentially martensitic structure, possibly with a residual quantity of austenite.

BACKGROUND OF THE INVENTION

The press-hardening of steel is a technique that has been known since the 1970s. In this method, a steel sheet blank with an alloy composition that is matched to the press-hardening method is heated to a temperature that permits an austenitization and preferably a complete austenitization. A complete austenitization usually occurs above the so-called $AC_3$ point, which can be read from corresponding multiple-substance phase diagrams and in particular, also depends on the composition.

After the heating and complete austenitization, such a steel is cooled at a speed that lies above the so-called critical hardening speed. This produces a fully martensitic structure, which gives the steel a high hardness, in particular of up to 1500 MPa and above.

The hardness of such a press-hardened steel is essentially determined by the carbon content since this determines the martensite hardness.

Other alloy elements in the composition essentially cooperate with the carbon to determine the hardenability; certain elements including boron influence the transformation behavior and in particular, function as so-called transformation-delaying elements. These transformation-delaying elements significantly decrease the temperature below which—even with the cooling above the critical hardening speed—fully martensitic structure would no longer be achievable and can therefore in some circumstances be used to favorably influence certain process parameters.

The usual procedure in press-hardening is to provide the corresponding steel, which is to be press-hardened, in the form of a sheet, to cut a sheet blank from this sheet, and to either deep-draw this sheet blank in a cold state and then heat it, insert it into a tool, and correspondingly cool it by means of contact with the cooling tool on all sides, or to heat the sheet blank and hot-form it in a tool and at the same time, to cool it at the corresponding speed.

In this intrinsically known method, the cooling rates are determined by the tool or more specifically by the contact of the press-hardening steel with the tool. In this connection, a low thermal conductivity, a low heat capacity, the heat transfer, the pressing pressure, and the percentage of press area, but also the flow temperature of a cooling medium such as water can influence and in particular reduce the achievable cooling rates.

In practice, it has also turned out that in the press-hardening method, due to the transfer of the hot sheet from the furnace to the press and in particular also due to high emissivities (high thermal radiation behavior) of the sheet or sheet blank, undesirable diffusion-controlled transformations can occur at high temperatures (ferrite).

It has also been possible to determine that the deep-drawing of these sheets in the hot state accelerates the transformation so that in this case, ferrite and bainite will form before the martensite does.

The object of the invention is to disclose a method for press-hardening steels, which facilitates and improves process control during press-hardening and makes it more reproducible.

SUMMARY OF THE INVENTION

Whereas particularly in the early period of press-hardening, only a relatively small number of steels were available and consequently, system geometry was matched to these steels, since then, many systems have come into use for press-hardening steel. Such existing systems have properties that determine particular process parameters such as temperature, handling time, etc. According to the invention, it is now possible to use classification numbers to carry out a simple classification of the press-hardened steel so that by means of the classification, it is possible to estimate whether or not this steel is suitable for press-hardening in an existing system or with existing, predetermined process parameters.

Conversely, for an existing desired steel, it is possible to predetermine certain system parameters and in particular, the cooling rate in the tool.

In this connection, the predetermined classification numbers and their ranges can be used to take into account the system parameters also as a function of the deformation strain.

Basically, high deformation strains result in the fact that martensite occurs at a reduced rate. Thus in order to achieve a desired martensite content, it is possible to estimate whether with a given deformation strain, the corresponding hardness will still be achieved.

In particular, for example, it is possible to estimate whether at given cooling rates, the steel used is suitable for the indirect press-hardening method or also for the direct press-hardening method. In the indirect press-hardening method, the steel is shaped before the press-hardening so that during the press-hardening itself, no forming occurs in the hot state. Such a process therefore requires a lower press-hardening number than for example a direct press-hardening process in which a forming is also carried out in the hot state.

It is thus possible to reduce the number of tests required before the system can be run with the particular steel and in particular, it is also possible to reduce the amount of scrap generated. In particular, it is possible to know whether with the given process parameters, a steel will undergo press-hardening in a boundary range in which the desired properties will not be reliably achieved in every component so that it is advantageously possible from the outset to eliminate a multitude of possible error sources.

According to the invention, a press-hardening number has been created for this purpose. The press-hardening number (PHZ) is a tool that makes it possible, based on the chemical composition and the cooling rate in the tool, to easily estimate whether the desired fully martensitic structure can be achieved. In the context of this disclosure, the expression "fully martensitic" is understood to mean a structural content of >90 vol. %, in particular >95 vol. % martensite, with residual austenite, residual ferrite, and/or bainite.

The press-hardening number can also be used to estimate whether the existing tool technology in connection with the sheet thickness (=cooling rate) is sufficient to obtain a fully martensitic structure. It is thus possible, for example, to determine whether in a tool, an alloy A will produce a martensite, but the alloy B will produce ferrite and martensite.

The press-hardening number can also be used to estimate which alloy is required in order to still become fully martensitic with a given deformation strain.

BRIEF DESCRIPTION OF THE DRAWINGS

The invention will be explained by way of example below in conjunction with the drawings. In the drawings:

FIG. 1: is a table with a plurality of steel compositions, showing the press-hardening number for each;

DETAILED DESCRIPTION OF THE PREFERRED EMBODIMENTS

FIG. 1 shows the press-hardening cooling rates initially measured for a wide variety of steel types.

In this table, P, S, and N are only contained as customary, unavoidable impurities. V and Ti are intentionally not included in the table and are alloyed in the range of <0.5%, in particular <0.2%.

In this case, Ti only serves to remove N by chemical combination, where Ti/N values (in at. %) of approx. 3.4 should be sufficient. All other values are given in mass %.

Based on the measured press-hardening cooling rates (PHM), according to the invention, two different formulas are required in order to determine the theoretical press-hardening cooling rate (PHK). In this case, it is necessary to differentiate between a theoretical press-hardening cooling rate (PHK) for steel materials whose dissolved boron content in the starting material is ≥5 ppm and a theoretical press-hardening cooling rate (PHK) for steel materials whose dissolved boron content in the starting material is <5 ppm.

The formula for the theoretical press-hardening cooling rates for material whose boron content dissolved in the starting material is ≥5 ppm is:

$$\text{PHK [K/s]}=1750/(28.5*C\%+3.5*Si\%+2.3*Mn\%-2*Al\%+4*Cr\%+3*Ni\%+25*Mo\%-20*Nb\%-6.3)^{2.7}.$$

For boron contents dissolved in the starting material that are <5 ppm, the following formula can be used for the theoretical press-hardening cooling rate:

$$\text{PHK [K/s]}=2750/(28.5*C\%+3.5*Si\%+2.3*Mn\%-2*Al\%+4*Cr\%+3*Ni\%+25*Mo\%-20*Nb\%-7.0)^{1.8}.$$

All percentages are generally given in mass percent.

The theoretical press-hardening cooling rates can deviate from the measured press-hardening cooling rates since certain reliability factors are built into them, for example in order to compensate for measurement uncertainties and a meaningful generalization has been carried out.

The press-hardening number (PHZ) is calculated from these established formulas and formula values as follows:

$$\text{PHZ}=\text{cooling rate in the tool (PHW)}/\text{theoretical press-hardening cooling rate (PHK)}.$$

According to the invention, the following laws apply in this connection:

PHZ<1: complete hardening through to martensite not assured

PHZ=1: a non-deformed or preformed sheet blank can be hardened=indirect process

PHZ>1: a sheet blank can be hot-formed and there is increasingly reliable prevention of plastic deformation during hardening (hot-forming suitability)

Figure 2:
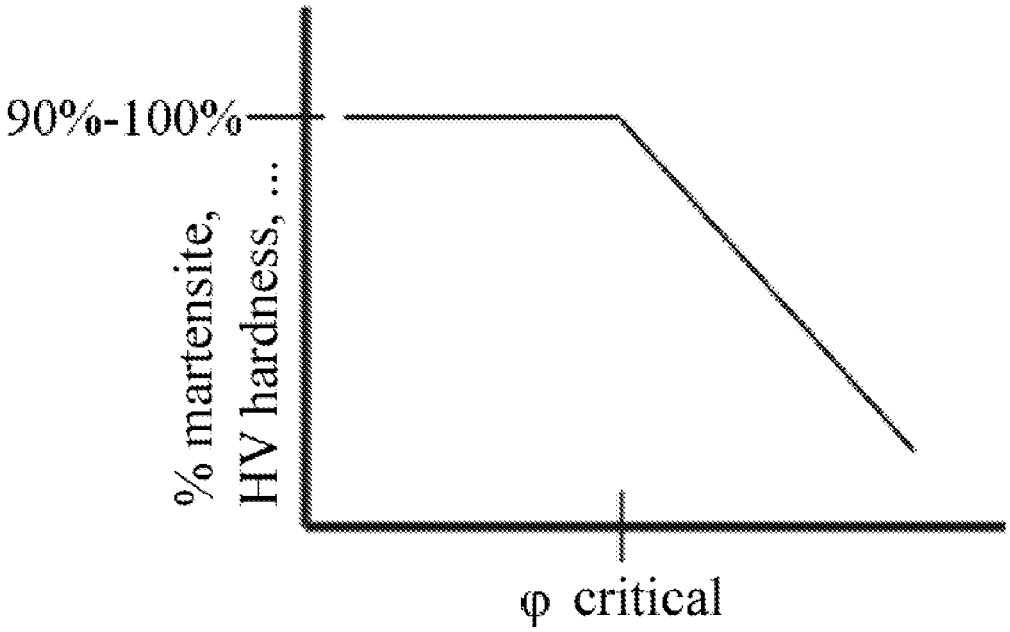
FIG. 2: qualitatively shows the dependency of martensite formation on the deformation strain.

In this regard, FIG. 2 qualitatively shows the relationship between the critical logarithmic deformation strain and the hardness, regardless of whether this measurement is carried out in % of martensite or HV hardness.

The critical logarithmic deformation strain for the one-dimensional case is calculated as follows:

$$\varphi = \ln\left(\frac{l_1}{l_0}\right) \ldots \text{ logarithmic deformation strain}$$

Figure 3:
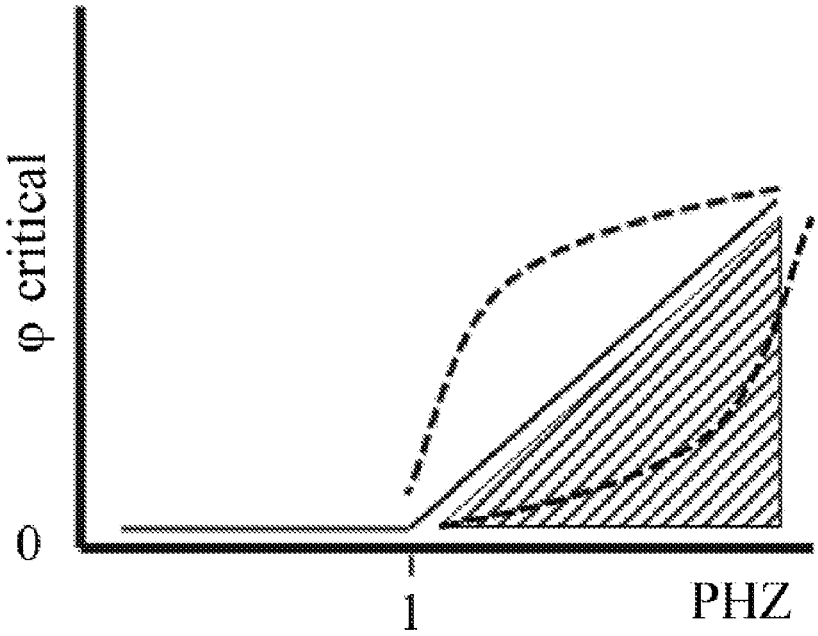
FIG. 3: shows the critical deformation strain as a function of the press-hardening number.

In this connection, FIG. 3 shows the press-hardening number in relation to the critical logarithmic deformation strain. The shaded region under the straight lines after the press-hardening number 1 indicates the region in which a reliable hot-forming should be possible. The dashed curves around the straight line indicate possible curve shapes since this increase does not necessarily have to occur in linear fashion.

By means of the press-hardening number or the theoretical press-hardening cooling rate, it is thus possible to determine, for an existing system, a steel material that will be hardened with a sufficient degree of reliability either in the indirect method or, because it has a high enough press-hardening number, even permits an effective direct press-hardening, i.e. forming in the hot state.

In order to do so, the theoretical press-hardening cooling rate (PHK) must be determined according to the formula and the cooling rate (PHW) that is achievable in continuous operation must be determined for the respective forming tool.

Conversely, with a given desired steel material, the given desired process, i.e. in the direct or indirect method, and a desired reliability factor, it is possible to determine the press-hardening number and then the effective cooling rate by converting the above-indicated formula.

The formula-based relationships in the theoretical press-hardening cooling rate are selected so that they also include common smaller influence factors such as a different flow temperature of the cooling water for the tool depending on the season.

The invention claimed is:

1. A method for press-hardening steel, comprising:

either preforming a steel sheet composed of a hardenable steel alloy in a cold state, then transferring the preformed steel sheet to a tool that essentially has a contour of the preformed component and, after a preceding heating step that produces a complete austenitization, cooling the preformed component in the tool at a speed that is greater than a critical hardening speed so that a quench hardening of the preformed component is achieved;

or heating a sheet blank composed of a steel with a composition that permits a press hardening to a temperature above an austenitization temperature and then hot-forming the sheet blank in a tool and at the same time, cooling the sheet blank at a speed that is greater than a critical hardening speed so that a hardening is produced; and the hardening is produced in that an austenitic structure is converted into an essentially martensitic structure, with an optional residual quantity of austenite; and determining a press hardening number in order to match the steel alloy to an existing system geometry as well as the cooling rate in the tool that is achieved during operation or to match a desired tool to a given steel type; wherein the press hardening number (PHZ) is determined based on the equation:

PHZ (press-hardening number)=cooling rate in the tool (PHW)/theoretical press-hardening cooling rate (PHK)

where the cooling rate in the tool is predetermined or measured for a desired sheet thickness and the theoretical press-hardening cooling rate (PHK) for steel material whose boron content dissolved in the starting material is >5 ppm, is determined as follows:

$$PHK\ [K/s]=1750/(28.5*C\%+3.5*Si\%+2.3*Mn\%-2*Al\%+4*Cr\%+3*Ni\%+25*Mo\%-20*Nb\%-6.3)^{2.7}$$

and for boron contents dissolved in the starting material that are <5 ppm, is determined as follows:

$$PHK\ [K/s]=2750/(28.5*C\%+3.5*Si\%+2.3*Mn\%-2*Al\%+4*Cr\%+3*Ni\%+25*Mo\%-20*Nb\%-7.0)^{1.8},$$

where: all percentages are given in mass percent

PHZ<1: complete hardening through to martensite not assured

PHZ=1: a non-deformed or preformed sheet blank can be hardened=indirect process

PHZ>1: in addition to the indirect process, a sheet blank can be hot-deformed and there is increasingly reliable prevention of plastic deformation during hardening (hot-forming suitability).

2. The method according to claim 1, wherein with a desired steel composition and a desired sheet thickness, the cooling rate in the tool (PHW) that is reliably achieved for this sheet thickness is measured and based on the desired steel composition and the desired sheet thickness, and the theoretical press-hardening cooling rate (PHK) is used to determine the press-hardening number (PHZ), where with a press-hardening number of 1, the desired steel composition and the given system can be used for an indirect press-hardening method and with a press-hardening number>1, the hot-forming is carried out with greater reliability as the press-hardening number increases.

3. The method according to claim 1, wherein with a known cooling rate in the tool (PHW), a steel alloy is selected based on the press-hardening number, where a selected steel has a press-hardening cooling rate (PHK) dimensioned so that for an indirect press-hardening method, at least a press-hardening number of 1 is achieved and for a hot-forming method, a press-hardening number of >2 is achieved.

* * * * *